US009545531B2

(12) United States Patent
Tagliareni et al.

(10) Patent No.: US 9,545,531 B2
(45) Date of Patent: Jan. 17, 2017

(54) FIRE SUPPRESSION SYSTEM INCLUDING AN INTEGRAL TIME DELAY AND OUTPUT STARTER WITH ATTACH AND DETACH FIRING PIN ASSEMBLY

(71) Applicant: Fike Corporation, Blue Springs, MO (US)

(72) Inventors: Russell V. Tagliareni, Lafayette, NJ (US); Edward Soohoo, Stanhope, NJ (US); Glen Stichling, Hawthorne, NJ (US)

(73) Assignee: Fike Corporation, Blue Springs, MO (US)

( * ) Notice: Subject to any disclaimer, the term of this patent is extended or adjusted under 35 U.S.C. 154(b) by 0 days.

(21) Appl. No.: 14/952,082

(22) Filed: Nov. 25, 2015

(65) Prior Publication Data

US 2016/0074685 A1 Mar. 17, 2016

Related U.S. Application Data

(63) Continuation of application No. 12/726,876, filed on Mar. 18, 2010, now abandoned.

(60) Provisional application No. 61/161,237, filed on Mar. 18, 2009.

(51) Int. Cl.

| | |
|---|---|
| ***A62C 37/10*** | (2006.01) |
| ***A62C 19/00*** | (2006.01) |
| ***A62C 13/00*** | (2006.01) |

(52) U.S. Cl.

CPC ..... *A62C 19/00* (2013.01); *A62C 13/006* (2013.01)

(58) Field of Classification Search

CPC ..... A62C 35/08; A62C 35/023; A62C 19/00; A62C 3/0285; A62C 3/06; A62C 99/00

USPC ..... 169/60, 68, 54, 45, 46

See application file for complete search history.

(56) References Cited

U.S. PATENT DOCUMENTS

| | | | |
|---|---|---|---|
| 1,510,843 | A | 10/1924 | Hawkins |
| 2,383,048 | A | 8/1945 | Eckert |
| 4,164,888 | A | 8/1979 | Looger et al. |
| 4,285,403 | A | 8/1981 | Poland |
| 4,338,861 | A | 7/1982 | Rhodes et al. |
| 5,992,528 | A | 11/1999 | Parkinson et al. |
| 6,283,032 | B1 | 9/2001 | Wardecki |
| 6,689,285 | B2 | 2/2004 | Rusin et al. |
| 7,472,758 | B1 | 1/2009 | Stevens et al. |
| 2007/0079972 | A1 | 4/2007 | Gross |
| 2007/0246229 | A1 | 10/2007 | Gross |
| 2011/0226492 | A1 | 9/2011 | Tagliareni et al. |

*Primary Examiner* — David Hwu
(74) *Attorney, Agent, or Firm* — Hovey Williams LLP

(57) ABSTRACT

A two-part starter mechanism for a powder aerosol generator fire suppression system is provided. Generally, the starter mechanism includes a pyrotechnic igniter assembly and a removable mechanical trigger coupled thereto. The igniter assembly is integrally formed with and/or embedded within the powder aerosol generator and operable, upon activation by the mechanical trigger, initiates a chemical reaction leading to the discharge of the powder aerosol fire suppressant. By being detachable, the mechanical trigger may be transported and stored separate from the pyrotechnic igniter thereby improving the overall safety of the fire suppression system.

14 Claims, 3 Drawing Sheets

FIRE SUPPRESSION SYSTEM INCLUDING AN INTEGRAL TIME DELAY AND OUTPUT STARTER WITH ATTACH AND DETACH FIRING PIN ASSEMBLY

RELATED APPLICATIONS

The present application is a continuation of U.S. patent application Ser. No. 12/726,876, filed Mar. 18, 2010, entitled Fire Suppression System Including an Integral Time Delay and Output Starter with Attach and Detach Firing Pin Assembly, which claims the priority benefit of prior U.S. Provisional Application No. 61/161,237, entitled Fire Suppression System Including an Integral Time Delay and Output Starter with Attach and Detach Firing Pin Assembly, filed Mar. 18, 2009.

BACKGROUND OF THE INVENTION

The invention disclosed here relates, in general, to the field of fire suppression systems, and more specifically to the starter mechanism that is required to ignite a fire suppression oxidizer contained within the housing of a fire suppression device. In another aspect, the invention also relates to a means for connecting and disconnecting a separate inert firing pin to the starter assembly prior to the use of the fire suppression device.

SUMMARY OF THE INVENTION

In one embodiment according to the present invention there is provided a fire suppression system comprising a housing containing a quantity of a chemical oxidizing compound. Upon ignition of the compound, the system is capable of generating a powder aerosol discharge. The system further includes a pyrotechnic igniter assembly for igniting the chemical oxidizing compound. The igniter assembly comprises a primer, a delay, and an output charge. The igniter assembly is integrated with the housing and communicates with the interior of said housing. The system also comprises a removable mechanical trigger coupled with the igniter assembly and is operable to initiate a firing sequence within the igniter assembly resulting in ignition of the output charge.

In another embodiment according to the present invention, there is provided an improved fire suppression system. In one aspect, for example, the system may be manually deployed within an enclosed space containing a fire; however, the present invention is not to be viewed as being limited to this application only. Generally, the fire suppression system comprises a housing containing a quantity of a chemical oxidizing compound which upon ignition of the compound is capable of generating a powder aerosol discharge, and a pyrotechnic igniter assembly for igniting the chemical oxidizing compound. A removable mechanical trigger that is coupled with the igniter assembly is employed to initiate a firing sequence within the igniter assembly resulting in ignition of the chemical oxidizing compound.

DETAILED DESCRIPTION OF THE PREFERRED EMBODIMENT

Dry powder and inert gas systems are useful fire suppression tools. Generally, a dry powder and inert gas fire suppression system extinguishes a fire by generating an aerosol comprising an extremely fine chemical dry-powder dispersed in inert gases. When introduced into a fire environment, the powder particles inhibit the fire's radical-forming chain reactions. Additionally, the aerosol dilutes the oxygen level in the immediate environment surrounding the fire and provides cooling. The chemical dry-powder and inert gases may be produced by a rapid, although non-explosive exothermic reaction of a potassium-containing compound such as potassium perchlorate, and especially a potassium and nitrogen-containing compound such as potassium picrate, potassium benzoate, and potassium dinitrophenate. During the reaction, the inert gases and fine powder particles are forcefully ejected from the aerosol generating apparatus and are thereby thoroughly mixed with the atmosphere proximal to the fire. The inert gases produced may comprise predominantly nitrogen, carbon dioxide, and water vapor, with lesser amounts of carbon monoxide and gaseous compounds of nitrogen.

Generally, the chemical reaction that results in aerosol formation is initiated by a pyrotechnic device such as a squib or cartridge. However, the use of pyrotechnic devices poses various safety issues with respect to the transport and storage of powder aerosol generator fire suppression systems. Further, these fire suppressions systems are often configured to be portable and manually actuated. Therefore, it is incumbent that the means of activating the pyrotechnic device be reliable and easy to use. Accordingly, the present invention alleviates many of these concerns by providing a means of reliably activating the pyrotechnic device while also making such fire suppression systems safe for transport and storage by providing a two-part igniter/trigger assembly.

Figure 1:
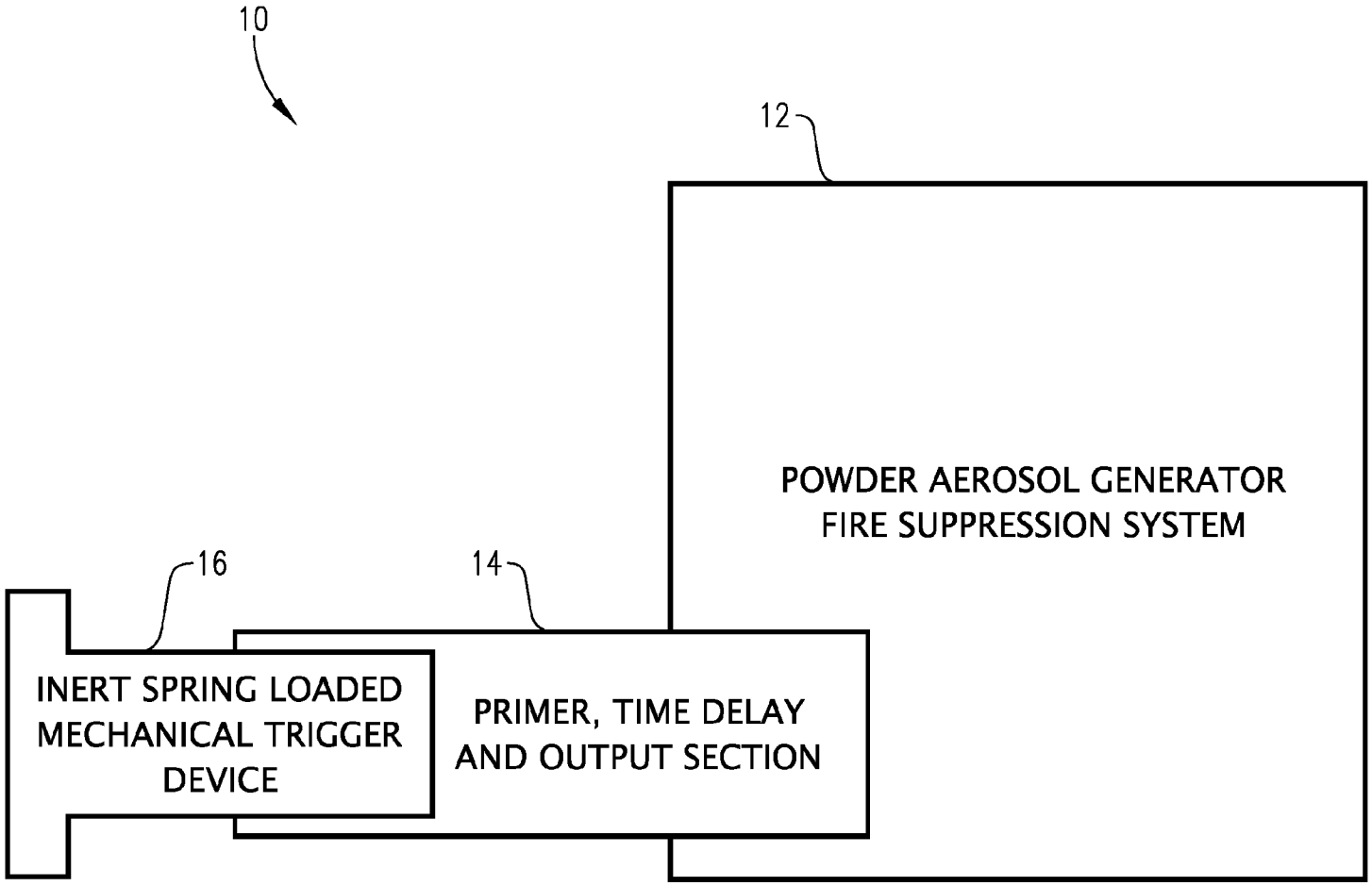
FIG. 1 is a block diagram of an exemplary fire suppression system arrangement, in which various embodiments of the present invention can be practiced.

Turning to FIG. 1, which schematically depicts an exemplary fire suppression system 10 according to the present invention, a powder aerosol generator 12 is provided with a pyrotechnic igniter assembly 14 that comprises a primer, a time delay, and an output charge section. As explained in greater detail below, in certain embodiments of the invention igniter assembly 14 is integrated with powder aerosol generator 12. Particularly, igniter assembly 14 is permanently installed within generator 12 so that the output charge section is operable to ignite the chemical oxidizing compound located within the generator. A removable, inert mechanical trigger device 16 is shown coupled to igniter assembly 14. The operation of trigger device 16 is also explained in greater detail below, however, trigger device 16 is separable from the igniter assembly 14, and is generally kept separate from igniter assembly 16 during transport and storage of the fire suppression system 10.

Figure 2:
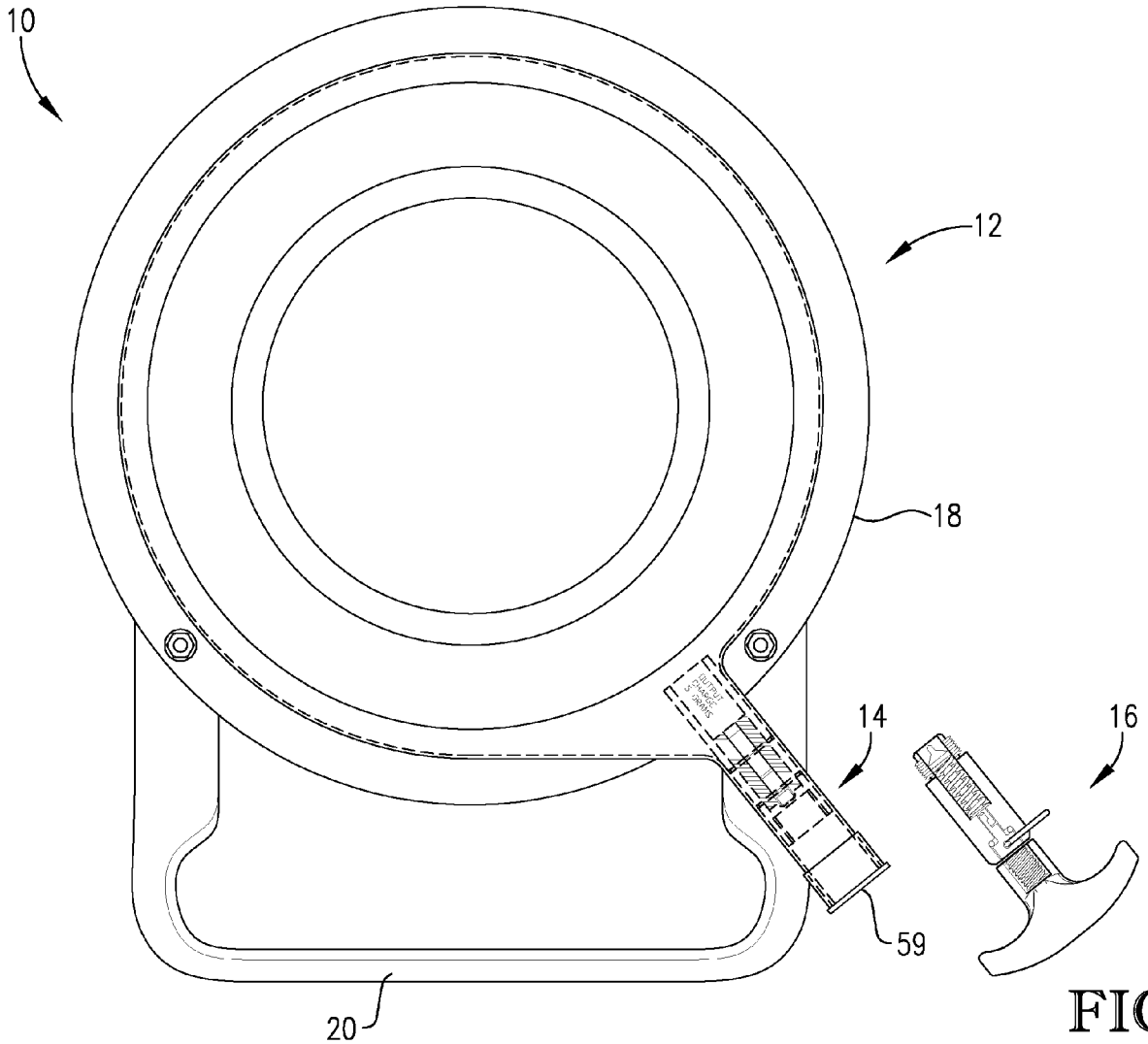
FIG. 2 is a cross-sectional view of a powder aerosol generator assembly in accordance with one embodiment of the present invention.

FIG. 2 illustrates one embodiment of a fire suppression system 10 made in accordance with the present invention. The powder aerosol generator 12 comprises a housing 18 containing a quantity of a chemical oxidizing compound. Upon ignition of the compound, the generator 12 releases a powder aerosol discharge. Generator 12 is equipped with a handle 20 that may be grasped by a user to assist with carrying and deployment of the fire suppression system 10.

Figure 3:
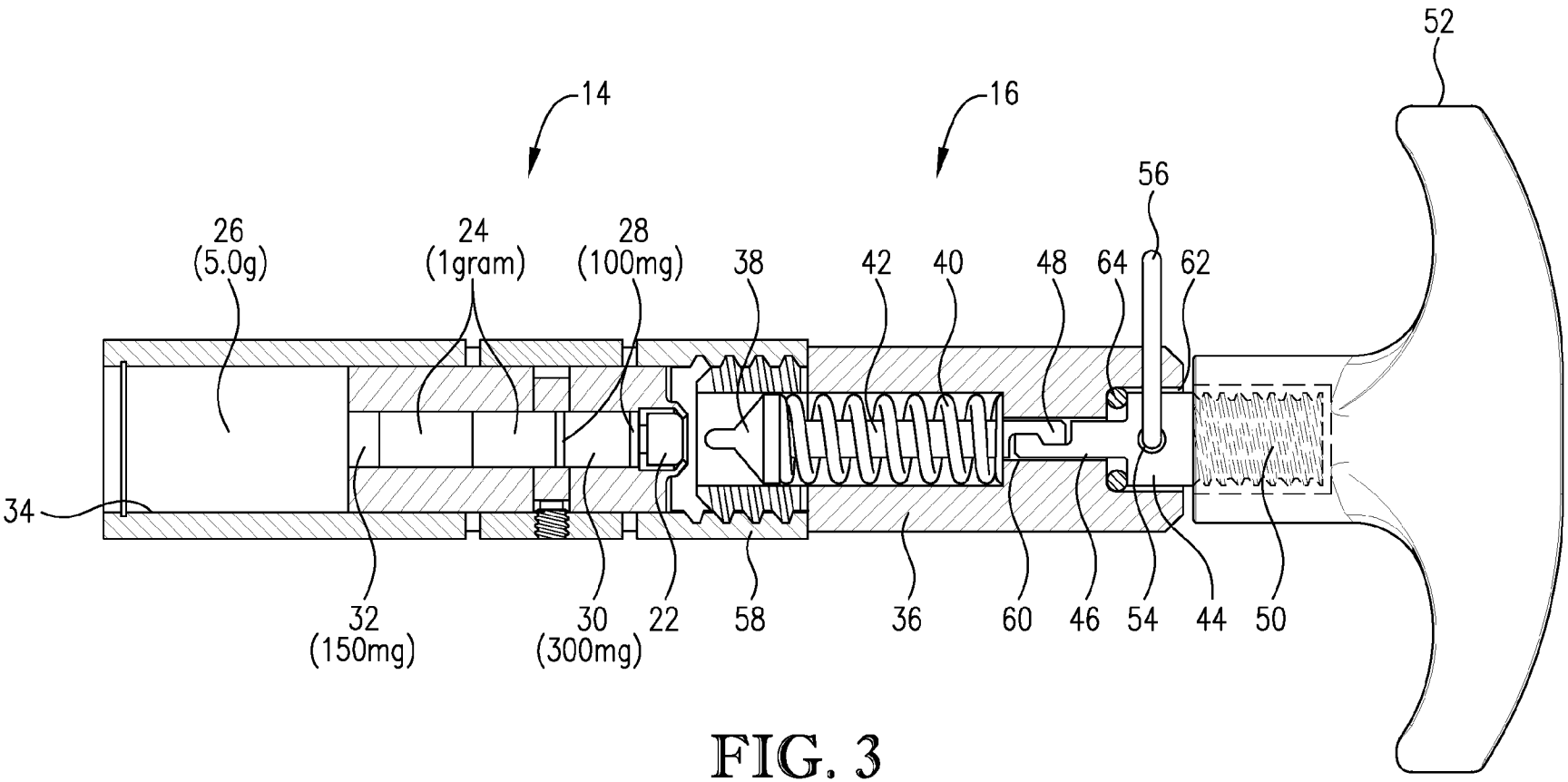
FIG. 3 is a cross-sectional view of the assembled igniter assembly of FIG. 2.

Igniter assembly 14 forms an integral part of the powder aerosol generator 12, and in certain embodiments according to the present invention is permanently installed therein. As shown in FIG. 3, igniter assembly 14 generally comprises a primer 22 (in certain embodiments an M42 primer), at least one time delay 24, and an output charge 26. Other components that may be present within igniter assembly 14 include one or more sections of ignition composition 28, an ignition charge 30, and a transfer charge 32. The output charge 26 is disposed within an output cavity 34 that communicates with the in interior of the powder aerosol generator housing 18 so as to initiate the aerosol-producing chemical reaction upon ignition of the output charge 26.

Trigger device 16 is an inert, mechanical trigger that does not include any pyrotechnic material and generally comprises a trigger body 36 inside of which is disposed a firing pin 38 and a spring 40 coiled about firing pin shaft 42. An actuator assembly 44 is slidably received, at least in part, within trigger body 36. A segment 46 of actuator assembly 44 is releasably coupled with a corresponding segment 48 of firing pin shaft 42. Actuator assembly 44 also comprises a threaded end portion onto which a handle 52 is secured. Note, it is within the scope of the present invention for other user interfaces, such as a cord, to be employed instead of a handle. Actuator assembly 44 further includes an annular orifice that is generally in registry with a corresponding orifice formed in the trigger body (not shown). Both orifices are configured to receive a removable safety pin 56 that when inserted prohibits shifting of firing pin 38 and actuator assembly 44 within trigger body 36.

As noted above, trigger device 16 is removable, or detachable, from igniter assembly 14. The end of trigger device 16 remote from handle 52 is threaded and configured to mate with corresponding threads formed in the igniter assembly outer end portion 58. When trigger device 16 is not coupled to igniter assembly 14, outer end portion 58 may be covered with a removable end cap 59 to protect primer 22 from damage or contact with debris. By being removable, trigger device 16 can be transported and/or stored separately from igniter assembly 14 and powder aerosol generator 12. In order to ready fire suppression system 10 for use, trigger device 16 may be mated with igniter assembly 14. Should it no longer be necessary for fire suppression system 10 to be ready for deployment, such as for storage or transport purposes, trigger device 16 may be disengaged from igniter assembly 14.

When desired to deploy the fire suppression system 10, the user, while holding onto generator handle 20 with one hand, removes safety pin 56 and then grasps and pulls on actuator handle 52 with the other hand. This action causes firing pin 38 and actuator assembly 44 to shift from an initial position wherein segments 46 and 48 reside in a narrow annular section 60 within trigger body 36 to a second position wherein segments 46 and 48 are located within a wider annular section 62 formed in the remote end of trigger body 36. This shifting also results in compression of spring 40 and creates a biasing force on firing pin 38. Note, an O-ring 64 is provided within annular section 62 to prevent moisture or other unwanted material from entering the interior of trigger body 36 while actuator assembly 44 and firing pin 38 are in the initial, un-activated position.

Upon reaching wider annular section 62, segments 46 and 48 are no longer confined and are thus free to unlatch from each other. This un-latching releases firing pin 38 thereby permitting it to shift toward igniter assembly 14 under the force of spring 40. Firing pin 38 strikes the primer 22 and initiates a firing sequence that results in ignition of the fire suppression material contained within housing 18. The primer 22 ignites ignition charge 30 which in turn ignites time delays 24 which in turn ignites output charge 26. The output charge 26 ignites the fire suppression compound. The time delays provide a window for the user to safely deploy the fire suppression system 10 into an area containing a fire prior to initiation of the chemical reaction resulting in aerosol discharge. The aerosol discharge then effectively operates as described above to suppress and/or extinguish the fire.

The foregoing description is provided by way of illustration and nothing therein should be taken as a limitation upon the overall scope of the invention. Numerous modifications, changes, variations, substitutions and equivalents will be apparent to those skilled in the art without departing from the spirit and scope of the invention.

We claim:

1. In a fire suppression system comprising a housing containing a quantity of a chemical oxidizing compound which upon ignition of the compound is capable of generating a powder aerosol discharge, the system further comprising a pyrotechnic igniter assembly for igniting the chemical oxidizing compound, wherein the system comprises the improvement of:

a removable mechanical trigger comprising a trigger body inside of which is located a spring-loaded firing pin, and an actuator assembly that is releasably coupled with said firing pin, at least a portion of said actuator assembly in its un-actuated state being slidably received within said trigger body;

said mechanical trigger being coupled with the igniter assembly, wherein said actuator assembly upon actuation causes said firing pin to shift away from said igniter assembly thereby compressing said firing pin spring until said actuator assembly disengages from said firing pin and initiates a firing sequence within the igniter assembly resulting in ignition of the output charge, said igniter assembly comprising a primer, a delay, and an output charge, and wherein ignition of said chemical oxidizing compound by said igniter assembly initiates an aerosol-producing chemical reaction thereby expelling said powder aerosol discharge from said housing.

2. The fire suppression system according to claim 1, wherein said mechanical trigger is threadably secured to the igniter assembly.

3. The fire suppression system according to claim 1, wherein the actuator assembly comprises a handle.

4. The fire suppression system according to claim 1, wherein said mechanical trigger comprises a removable safety pin that inhibits shifting of said actuator assembly and firing pin.

5. The fire suppression system according to claim 1, wherein said igniter assembly comprises an igniter body defining an igniter bore, said primer, delay and output charge being located within an inboard portion of said bore, at least a portion of said trigger body being received within an outboard portion of said bore.

6. The fire suppression system according to claim 5, wherein the portion of said trigger body received within said outboard portion of said bore includes said firing pin.

7. The fire suppression system according to claim 5, wherein the portion of said trigger body received within said outboard portion of said bore includes at least a portion of the spring associated with said spring-loaded firing pin.

8. The fire suppression system according to claim 1, wherein upon disengaging from the actuator assembly, the firing pin shifts toward and contacts a portion of the igniter assembly thereby initiating said igniter assembly firing sequence.

9. The fire suppression system according to claim 1, wherein said chemical oxidizing compound comprises a potassium-containing compound selected from the group consisting of potassium perchlorate, potassium picrate, potassium benzoate, and potassium dinitrophenate.

10. The fire suppression system according to claim 1, wherein said aerosol-producing chemical reaction comprises gaseous and solid particulate reaction products, wherein said gaseous reaction product comprises a gas selected from the group consisting of nitrogen, carbon dioxide, water vapor, carbon monoxide, gaseous nitrogen compounds, and mixtures thereof.

11. A method of extinguishing a fire with a fire suppression system comprising a housing containing a quantity of a chemical oxidizing compound which upon ignition of the compound is capable of generating a powder aerosol discharge, the system further comprising a pyrotechnic igniter assembly for igniting the chemical oxidizing compound, said method comprising:

attaching a mechanical trigger to said igniter assembly, said mechanical trigger being free of pyrotechnic material and configured for detachment and reattachment to said igniter assembly, said igniter assembly being permanently installed within said housing and comprising a primer, a delay, and an output charge;

removing a safety pin from said mechanical trigger;

actuating said mechanical trigger, said removing step and said actuating step occurring while holding a handle equipped to said housing, wherein said actuating step initiates a firing sequence within said igniter assembly resulting in ignition of said output charge, and wherein ignition of said chemical oxidizing compound by said igniter assembly initiates an aerosol-producing chemical reaction thereby expelling said powder aerosol discharge from said housing; and deploying said fire suppression system into a fire environment prior to initiation of the chemical reaction resulting in aerosol discharge.

12. The method according to claim 11, wherein said mechanical trigger comprises a trigger body inside of which is located a spring-loaded firing pin, and an actuator assembly that is releasably coupled with said firing pin.

13. The method according to claim 12, wherein the actuator assembly comprises a handle, said method further comprising:

pulling said actuator handle while also holding said handle equipped to said housing, wherein said pulling shifts said firing pin and actuator assembly from an initial position wherein a pair of latched segments reside in a narrow annular section within said trigger body to a second position wherein said pair of latched segments are located within a wider annular section formed in the remote end of said trigger body, wherein said shifting of said firing pin causes compression of a spring and creates a biasing force on said firing pin and said shifting causes said latched segments to become unlatched within said wider annular section, thereby causing said firing pin to shift toward said igniter assembly, strike said primer, and initiate said firing sequence.

14. The method according to claim 11, wherein prior to said attaching step, removing an end cap covering an outer portion of said igniter assembly.

* * * * *